US005564593A

United States Patent [19]

East, Sr.

[11] Patent Number: 5,564,593

[45] Date of Patent: Oct. 15, 1996

[54] APPARATUS FOR DISPENSING MEDICATION

[75] Inventor: Elvin E. East, Sr., Cordele, Ga.

[73] Assignee: Medication Management & Consulting, Inc., Cordele, Ga.

[21] Appl. No.: 524,471

[22] Filed: Sep. 7, 1995

[51] Int. Cl.[6] ..... B65D 83/04

[52] U.S. Cl. ..... 221/3; 221/2; 221/4; 221/15; 221/30; 221/121; 221/79

[58] Field of Search ..... 221/2, 3, 4, 5, 221/15, 30, 31, 79, 87, 121, 122

[56] References Cited

U.S. PATENT DOCUMENTS

| | | | |
|---|---|---|---|
| 3,712,507 | 1/1973 | Holt | 221/82 |
| 3,929,254 | 12/1975 | Aetze | 221/30 |
| 3,998,356 | 12/1976 | Christensen | 221/2 |
| 4,519,522 | 5/1985 | McElwee | 221/79 |
| 4,572,403 | 2/1986 | Benaroya | 221/3 |
| 4,674,651 | 6/1987 | Scidmore et al. | 221/3 |
| 4,695,954 | 9/1987 | Rose et al. | 364/413 |
| 4,785,969 | 11/1988 | McLaughlin | 221/2 |
| 4,798,309 | 1/1989 | Stone et al. | 221/15 |
| 4,809,877 | 3/1989 | Albright | 221/75 |
| 4,811,764 | 3/1989 | McLaughlin | 141/98 |
| 4,838,453 | 6/1989 | Luckstead | 221/15 |
| 4,953,745 | 9/1990 | Rowlett, Jr. | 221/5 |
| 5,044,516 | 9/1991 | Hoar | 221/2 |
| 5,097,982 | 3/1992 | Kedem et al. | 221/3 |
| 5,152,422 | 10/1992 | Springer | 221/2 |
| 5,159,581 | 10/1992 | Agans | 368/10 |
| 5,176,285 | 1/1993 | Shaw | 221/3 |
| 5,239,491 | 8/1993 | Mucciacciaro | 364/569 |
| 5,246,136 | 9/1993 | Loidl | 221/3 |
| 5,272,321 | 12/1993 | Otsuka et al. | 221/2 |
| 5,368,187 | 11/1994 | Poncetta et al. | 221/30 |
| 5,464,118 | 11/1995 | Gray et al. | 221/31 |

*Primary Examiner*—H. Grant Skaggs
*Attorney, Agent, or Firm*—Hopkins & Thomas; Malvern U. Griffin

[57] ABSTRACT

An apparatus for dispensing a combination of medications in dose lots at timed intervals comprising the following: a housing (12); a plurality of dose modules (32) rotatably mounted in the housing, each dose module including at least one circular disc (34), each of the discs having a plurality of apertures (36) therethrough, wherein each aperture is sealed on either side with film (38, 39) so as to form a compartment which contains a single dose of a medication; extractor means (110) mounted to the housing for selectively piercing the film coveting the apertures so as to release the medication contained in respective apertures; signaling means (92, 182) mounted to the exterior of the housing for periodically indicating a time medication is to be taken; and dose module index means (150, 152) for indexing each dose module at a predetermined interval and for actuating the signaling means. In an alternative embodiment, the dispenser is controlled by a microprocessor system (188).

20 Claims, 5 Drawing Sheets

APPARATUS FOR DISPENSING MEDICATION

FIELD OF THE INVENTION

The present invention generally relates to medication dispensing devices, and more particularly, to an apparatus for dispensing individually sealed medications in dose lots and in accordance with various administration schedules.

BACKGROUND OF THE INVENTION

The elderly population of the United States is ever increasing as advancements in medical science bring about almost continual progress in the treatment and cure of terminal illnesses and as well as in the science of geriatrics. This is particularly true in the science of pharmacology. New pharmaceutical drugs are being introduced almost daily to address the diseases and disabilities associated with the aging process of the human body.

As a result, more medications are being prescribed today than ever before. In fact, most elderly people are taking more than one medication a day, usually at different times throughout a day. Moreover, the medication is often taken for an extended period of time, especially when the person suffers from a chronic illnesses or other long-term need such as a dietary or hormonal disfunction.

A known problem associated with administering prescription medication to an elderly person is making sure the medication is taken at the appropriate time without skipping or doubling up on any one dose. Consider, for example, an individual taking three different medications a day in different combinations and at different times throughout the day. It can quickly become a logistical nightmare trying to administer the appropriate medication at the appropriate time during the day.

While some elderly people are able to adequately follow their medication administration schedules without creating a risk to their health, many are not able to do so for various reasons, such as the loss of short term memory associated with aging. Further, individuals who are home bound or institutionalized face other difficulties maintaining their medication administration schedules.

A home bound individual is typically under the care of a family member or nurse or both, and therefore must rely on that person(s) to obtain their medication from the local pharmacy in a timely manner. Once they have obtained their medication, the person(s) which cares for that individual must coordinate the administration of the different medications at prescribed intervals of time. This can become quite confusing, as previously discussed, when the individual must take three to fifteen or more different medications, each at a different time throughout the day, especially when more than one person is responsible for administering the different medications. As mentioned, elderly patients often have problems remembering when to take their medication and/or remembering if they even took their previous dose of medication, inhibiting their ability to resolve issues about whether or not they took their previous dose. If no record is available indicating whether the person took their previous dose or not, the individual may become subject to various health risks associated with either missing a dose or overdosing on a subsequent dose.

An inherent problem with the administration of prescribed medication in the conventional format is that neither the pharmacist nor the prescribing doctor have control over the administration of the medication to the person. This is largely due to the cost which would be incurred by having such control exercised by a physician or pharmacist, though, this comes at the cost of placing the health of many individuals at risk if the medication is improperly administered. Another inefficiency of the conventional format is that prescriptions are filled in prescription lots rather than dose lots. This means that a prescription is filled for the needs of a patient over an extended interval of time, typically fifteen to thirty days, wherein all the medication is placed in a single container. Several of the inadequacies of this format for filling prescriptions can be best seen in the nursing home or institutional setting as described below.

Prescription drugs are delivered to long term health care facilities in packages known as blister packs or bingo cards. A months supply of medication for each patient is sent at a time. A typical long term health care facility receives 700 to 1500 of these packages a month. These packages are then filed in cabinets or medicine carts with a compartment for each patient.

Before these medications can be administered to the patients, they must be repackaged into dose lots, and delivered to the patient's room. This re-packaging involves removing the medications for each patient from their file, and sight verifying the medications in each package against the patient's active prescription record. The verified medications are then placed into dose lot cups labeled with the patient's name and room number and transported on mobile carts to the patient's room for administration.

After the medications are removed from their sealed packages, they become subject to contamination and can no longer be fully identified. For this reason, most state pharmacy laws require the medications to be administered in a relatively short time after they are removed from their labeled and sealed packages, unless the system used provides for protection of the medications from contamination and each medication is "fully labeled" in accordance with the packaging and labeling laws and regulations promulgated by the Food and Drug Administration (FDA).

Current art does not provide dose lot medication packaging and dispensing systems permitting medications to remain sealed and fully labeled up to the time of administration. For this reason long term health care facilities are required to package medications into dose lot cups on a daily basis.

Medications are packaged into dose lots by licensed practical nurses (LPN), working under the supervision of a registered nurse (RN). This is expensive and turn over among nurses often results in inexperienced LPN's packaging medications, causing delays in the daily medication of patients.

Present medication administration systems in use permit practically no flexibility as to the time a particular patient can be medicated because the medications must be packaged and delivered to the patients on carts which are pushed from room to room on a rigid schedule, regardless of the patient's whereabouts during the medication schedule. Patients may not be medicated during recreation and meal times and are not always in their rooms when the medication carts come to their rooms. Patients are often being given other treatments during a medication time, or may be simply visiting another patient. The present systems are analogous to shooting at moving targets with a scatter gun. Many patients simply get missed and fail to receive their medications on schedule or miss it altogether.

In regard to automated medication dispensing devices, several improvements have been made in an effort to make a dispenser that will conveniently dispense the appropriate dose of medication at the appropriate time. Examples of such devices are found in U.S. Pat. No. 4,953,745 to Rowlett, Jr., U.S. Pat. No. 5,097,982, to Kedem et al., and U.S. Pat. No. 5,152,422 to Springer. Each of these devices seeks to dispense several different types of medication at predetermined intervals for consumption by a patient. However, none of these devices nor any other device known to the inventor is capable of dispensing medication from a fully labeled, individually sealed configuration into dose lots at programmed intervals for administration to patients.

SUMMARY OF THE INVENTION

An object of the present invention is to overcome the deficiencies and inadequacies of the prior art as noted above and as generally known in the art.

Another object of the present invention is to provide a programmable medication dispenser capable of dispensing fully labeled, individually sealed medications in dose lots, thereby preventing cross-contamination of the medications.

Another object of the present invention is to provide a programmable medication dispenser that breaks the seal about individually sealed medication in order to dispense the medication therein for administration to a patient.

Another object of the present invention is to provide means for individually packaging prescription medication in dose lots and for adequately labeling the medication in accordance with the applicable state and Federal laws.

Another object of the present invention is to provide a programmable medication dispenser with audible and visual signals for indicating when a medication dose is to be taken.

Another object of the present invention is to provide a programmable medication dispenser capable of retaining historical data regarding a patient's consumption of prescribed medication.

Another object of the present invention is to provide a programmable medication dispenser which is inexpensive to manufacture, durable in structure, and efficient in operation.

Briefly, stated the present invention is a programmable medication dispenser for dispensing fully labeled, individually sealed medications in dose lots at programmed intervals. The programmable medication dispenser comprises a housing in which a plurality of dose modules are rotatably mounted. Each dose module includes one or more circular medication discs. Each medication disc includes a plurality of equally spaced apertures therethrough, typically disposed about the perimeter of the disc, and a first film layer applied to the top and a second film layer applied to the bottom of the disc so as to cover the apertures to form individual compartments that house a single dose of a particular medication. Several discs which contain different medications that are to be taken at the same time can be grouped together and stacked vertically forming a dose module. The medication extracted from a dose module for a particular administration period is referred to as a dose lot. For instance, a dose lot may comprise a single pill extracted from a dose module having only one medication disc, or may comprise two pills extracted from a dose module having two medication discs, etc.

An extraction device is mounted to the housing for piercing the film layers covering the apertures of the dose module so as to extract the medication therein. The extraction device is configured so that the film is not completely severed from the disc, thereby preventing the film from being intermixed with the medication. Moreover, to indicate a time when a particular dose lot of medication is to be taken, the present invention provides signaling means in the form of audible and visual indicators mounted to the housing.

A dose module index means is provided in the housing for indexing each dose module between doses and for actuating the signaling means at programmed intervals. In the preferred embodiment, the dose module index means comprises a cam shaft mounted vertically in the housing and disposed in frictional contact with each dose module. For each dose module in the programmable medication dispenser, the cam shaft is provided with two programmable cams, one for indexing the dose module between doses and one for actuating the signaling means when that particular dose lot to be taken. The cam shaft is driven by a timer mechanism located in the housing.

The extraction device of the preferred embodiment comprises an elongated shaft having an arcuate cutting edge at one end and a handle at the opposite end. The shaft is urged downwardly piercing the film and passing through an aperture so as to release the medication contained in the aperture. A portion of the shaft comprises a longitudinally disposed flat cutaway surface whereby the film contiguous the flat cutaway surface remains attached to the disc when the shaft is urged through the aperture.

The dose modules are mounted in the housing on respective sliding disc carriages which are normally locked in position until the medication of that dose module is to be taken. At such time, the index means actuates the signaling means and unlocks the disc carriage, allowing the disc carriages to be slid forward into an operative position with respect to the extraction device. Then, by actuating the extraction device, the medication of that particular dose module is released from the medication disc(s) for administration to the patient.

The dose lot released from a dose module is received in a dose tray located in the housing beneath the plunger means. The dose tray can be removed from the housing for administering the medication to a patient.

Furthermore, the programmable medication dispenser of the present invention provides one or more trays containing non-solid medications which cannot be packaged in the medication disc of the present invention. These trays are preferably mounted above the sliding platforms and have associated with them a similar signaling means for indicating when the medication is to be administered to the patient. The tray compartment may or may not be secured from access other than during administration periods depending upon the particular use of the programmable medication dispenser and/or the medication contained within the respective trays.

In an alternative embodiment, the index means include a microprocessor that controls the indexing of the dose modules, the actuation of the signaling means, the actuation of the disc carriages, and the actuation of the plunger means. To facilitate control over the aforementioned operations, the housing is provided with solenoids and motors that are interfaced with and controlled by the microprocessor.

Other objects, features, and advantages of the present invention will become apparent from the following description when considered in conjunction with the accompanying drawings.

BRIEF DESCRIPTION OF THE DRAWINGS

This invention, as defined in the claims, can be better understood with reference to the following drawings. The drawings are not necessarily to scale, emphases instead being placed upon clearly illustrating principles of the present invention.

DETAILED DESCRIPTION OF THE PREFERRED EMBODIMENT

Figure 1:
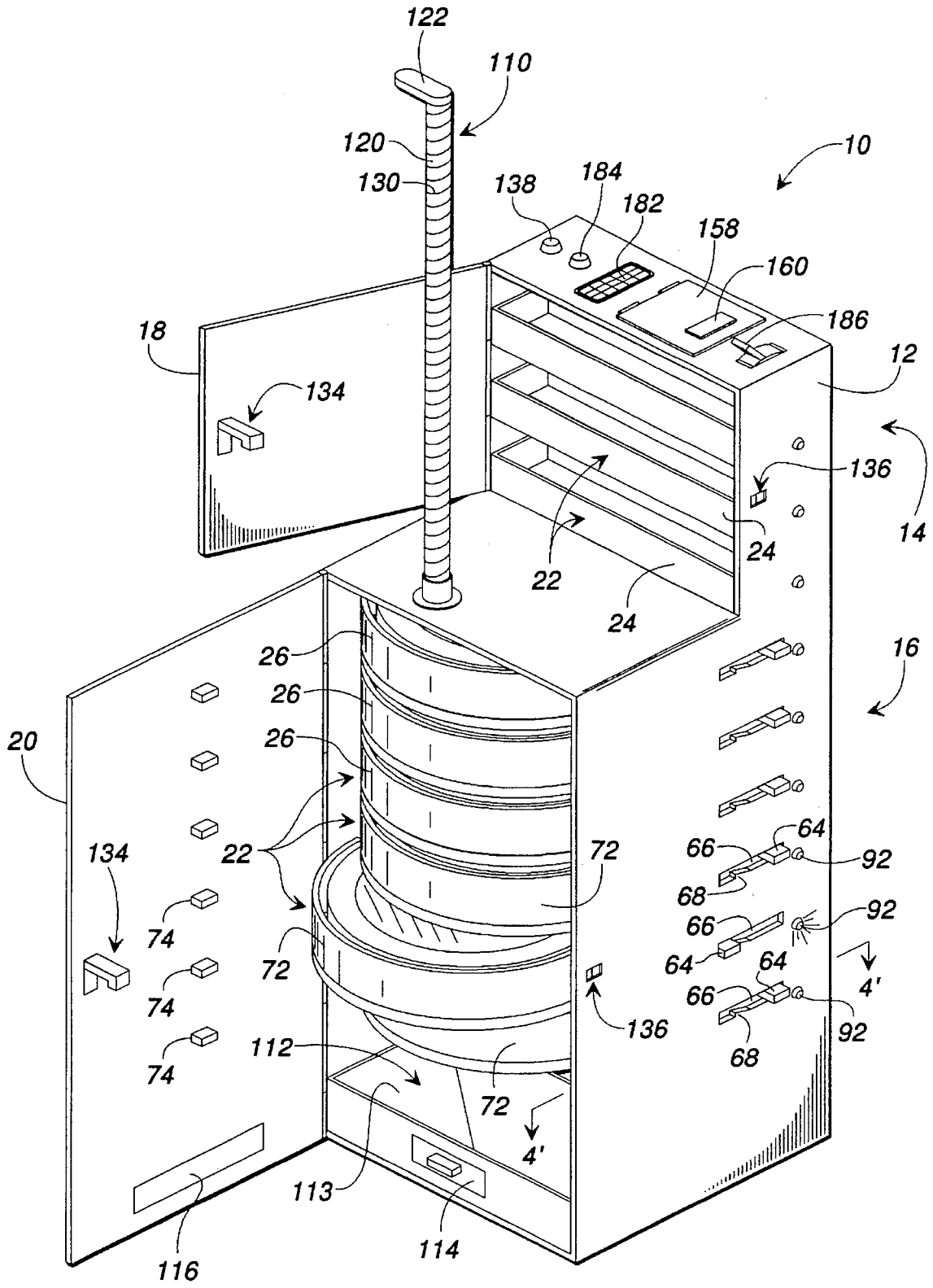
FIG. 1 is a perspective view of a programmable medication dispenser in accordance with the present invention.

With reference to the drawings wherein like reference numerals represent corresponding parts throughout the several views, FIG. 1 illustrates a programmable medication dispenser (PMD) 10 in accordance with the present invention. The PMD 10 comprises a housing 12 having a non-solid medication section 14 and a solid medication section 16. Each sections 14, 16 is accessible from the front of PMD 10 via locking doors 18, 20, respectively. The sections 14, 16 remain locked at all times unless medication is being removed in accordance with a scheduled time and/or when PMD 10 is being filled with medication. Each medication section 14, 16 can be divided into one or more medication compartments 22, each medication compartment being configured to receive one or more medications comprising a dose lot which is to be administered to a patient at a scheduled time referred to as a medication schedule.

In section 14, medication compartments 22 comprise sliding trays 24 in which non-solid medication such as suppositories, inhalers, or creams are placed. In section 16, where solid medication is stored, medication compartments 22 include sliding disc carriages 26 which receive a dose module 32 from which dose lots are extracted, as described in detail hereinafter.

Figure 2:
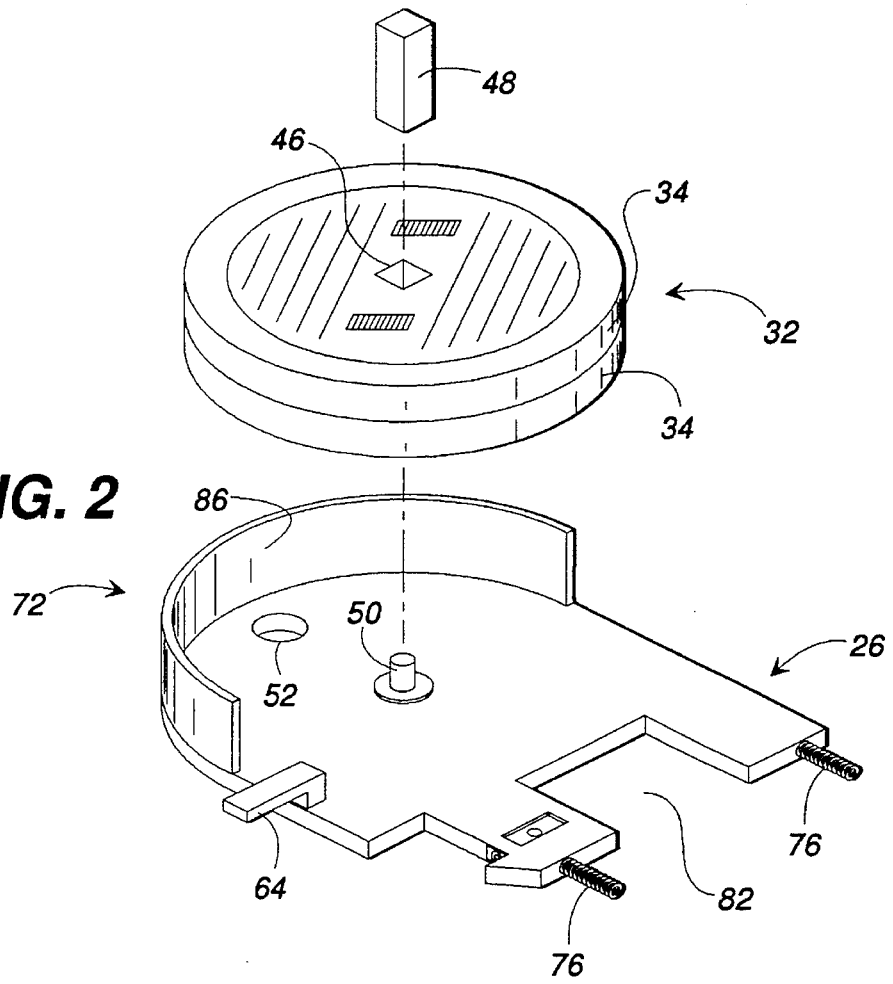
FIG. 2 is a partially exploded perspective view of a dose module positioned on a disc carriage of the dispenser of FIG. 1.
Figure 3:
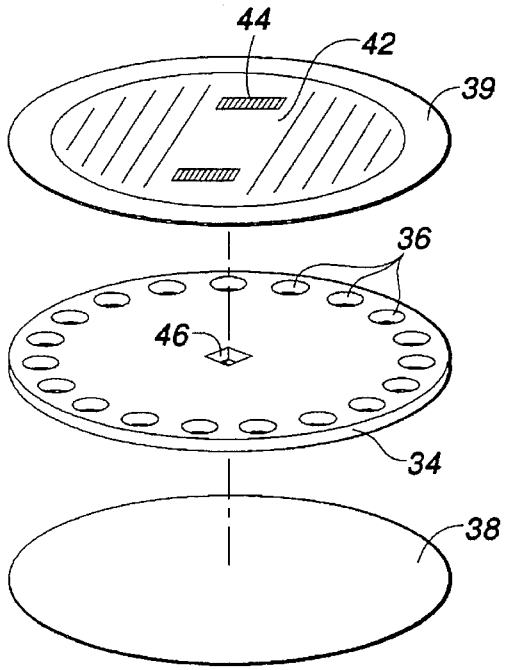
FIG. 3 is an exploded perspective view of a medication disc in accordance with the present invention for use with the dispenser of FIG. 1.

As shown in FIG. 2, each sliding disc carriage 26 is configured to receive a dose module 32 in a manner such that the dose module is rotatable thereon. The medication disc 34 is constructed out of plastic, styrofoam or another suitable material which allows the disc to be light weight, durable, easy to manufacture, and if desired, disposable. Each dose module 32 comprises one or more circular medication disc 34, as generally illustrated in FIG. 3. Each medication disc 34 includes a plurality of cylindrical apertures 36 which are individually sealed by a bottom film layer 38 and a top film layer 39 attached to disc 34, and thereby forming individual compartments where individual doses of medication are contained. By individually sealing the medication, the present invention prevents cross-contamination between medications. In the preferred embodiment, film layer 38 comprises thin aluminum foil and film layer 39 comprises a thin transparent film, such as Mylar®. Film layers 38, 39 can be attached to disc 34 in any number of ways as can be appreciated by one of ordinary skill in the art, such as by gluing them to disc 34 using any medically approved adhesive.

A label 42 is attached to film layer 39 to provide a variety of information as required by both Federal and state law for the packaging of prescription medication, such as the name of the particular medication contained in disc 34, directions for administration, the pharmacy which packaged disc 34, the date disc 34 was packaged, the doctor who prescribed the medication, the expiration date of the medication, and the patient's name. In addition to such information being written upon label 42, bar codes 44 provided on label 42 enable mass packaging and reclaiming of disc 34 in an automated manner. By providing a suitable place on the disc for a label having the information required by the applicable state and Federal laws, the medication can be packaged in dose lots far in advance of when it is delivered to the patient. This is particularly desirable with patients who take medication on a long term basis at home or in a long term health care facility because it would reduce the labor intensive activity of reducing the prescription lots into dose lots for administration to the patient.

A centrally positioned alignment hole 46 is provided in disc 34 for receiving an alignment shaft 48. The alignment shaft 48 passes through the alignment hole 46 of each disc 34 which comprise the dose module so as to align respective apertures 36 of the disc which comprise the separate dose lots. The alignment shaft 48 is a rectangular block having a bore (not shown) in its lower end configured to receive an upwardly projecting rotation pin 50 centrally mounted to the top surface of disc carriage 26 (FIG. 2). This allows dose module 32 to be rotatably attached to disc carriage 26 while maintaining the alignment of the respective apertures 36 comprising the separate dose lot. When the dose module is in place on disc carriage, the dose lots of the dose module can be selectively positioned over an aperture 52 of sliding disc carriage 26 for purposes of being extracted in the manner described below. Guide means (not shown), such as visual alignment markers, are provided on dose module 32 and disc carriage 26 to ensure that the dose module 32 is aligned on the disc carriage upon loading so that, while in use, the apertures 36 of the discs concentrically align with apertures 52 in the disc carriage.

Figure 4:
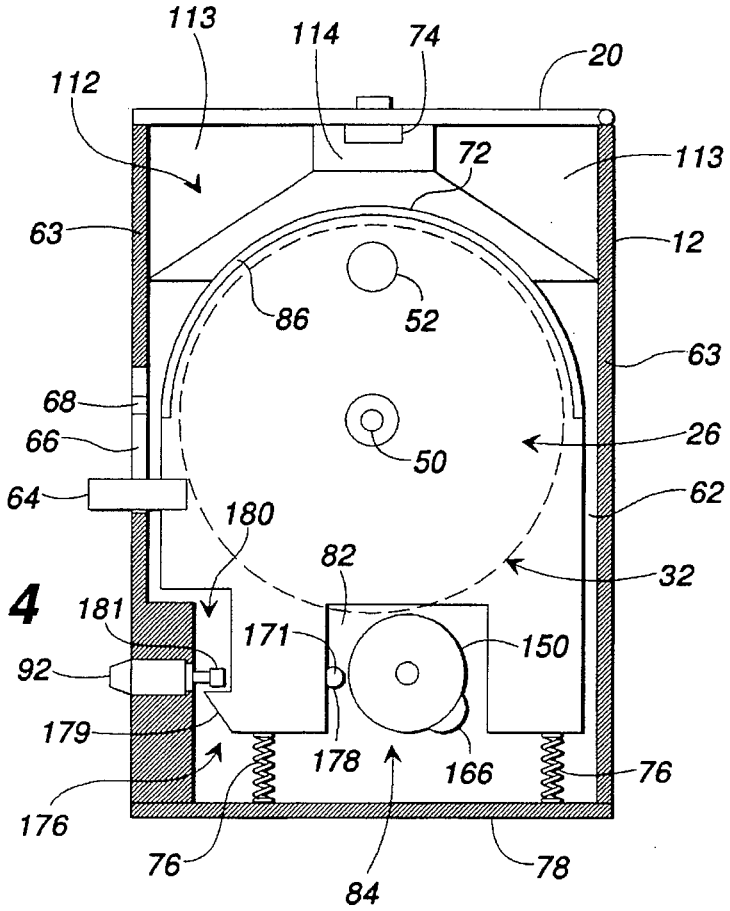
FIG. 4 is a top plane view of a disc carriage positioned within the dispenser of FIG. 1 taken substantially along line 4'—4' of FIG. 1.
Figure 6:
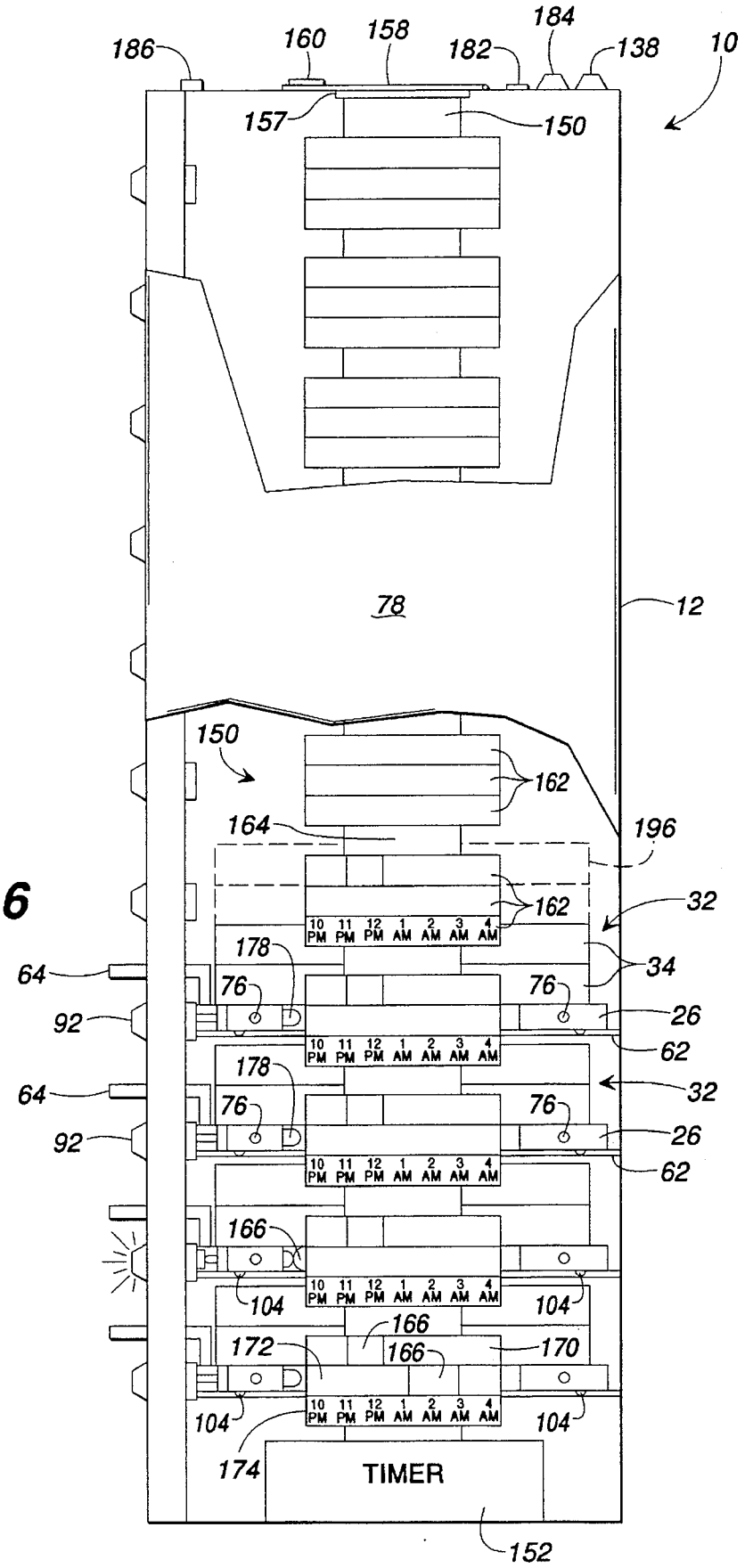
FIG. 6 is a partially cut away rear elevational view of the dispenser of FIG. 1 illustrating the index means.

Disc carriages 26 are slidably secured in housing 12 in the manner shown in FIGS. 1, 4 and 6. Each disc carriage 26 resides within individual medication compartment 22. A disc platform 62 supports each respective disc carriage 26, as shown generally in FIGS. 4 and 6. The disc platform 62 is a substantially square planar member which is rigidly secured to the interior surface of the side walls 63 of housing 12. Each disc platform 62 is provided with longitudinal grooves running front to rear on its top surface. These grooves are configured to receive corresponding ridges (not shown) on the bottom of disc carriages 26 as generally denoted by reference numeral 104 in FIG. 6. The configuration 104 maintains disc carriage 26 in a desirable orientation within housing 12 when slidably actuated.

As shown in FIG. 4, a laterally extending slide lever 64 is attached to the top surface of disc carriage 26 adjacent to one side so as to protrude through an opening 66 (FIGS. 3 and 4) in housing 12. Opening 66 is a lengthwise slot of a size sufficient to provide slide lever 64 the range of motion necessary to move disc carriage 26 from a rear position adjacent the rear of housing 12, as shown in FIG. 4, to a forward position adjacent the front of housing 12, as shown by a disc carriage 26 in the lower portion of PMD 10 in FIG. 1. In the forward position, slide lever 64 is held in position by detent means 68, such as a notch protruding into opening 68. Accordingly, the disc carriage can be moved from the rear position to the forward position and held in the forward position until slide lever 64 is released by the operator. Once released, disc carriage 26 returns to the rear position under the force of springs 76 secure at one end to disc carriage 26 and at the opposite end to the rear wall 78 of housing 12.

In order to extract the medication comprising a dose lot from a dose module 32, the corresponding disc carriage 26 is moved to the forward position. In the forward position, an arcuate front edge 72 of disc carriage 26 rest upon a support block 74 mounted to the inside vertical surface of door 20. Once positioned accordingly, an extraction device 110 mounted to housing 12 is actuated in order to cut away film layers 38, 39 coveting apertures 36 containing the dose lot of dose module 32. By cutting film layers 38, 39, the medication contained within each aperture 36 is released allowing the medication to fall under the force of gravity into compartment 112. A vertically extending deflector wall 86 is provided about the arcuate edge 72 of disc carriage 26 in order to prevent medication extracted from a dose module from being lodged on or around a lower disc carriages 26. The deflector wall 86 can be hinged on one side about a vertical axis so that it can be pivoted out of the way when a dose module 32 is being loaded into the housing 12. In compartment 112, slanted surfaces 113 direct or funnel the extracted medication into a dose tray 114 disposed at the bottom of compartment 112. The dose tray 114 is slidably received in housing 12 so that it can be easily removed and replace through a slot 116 in door 20.

Figure 5:
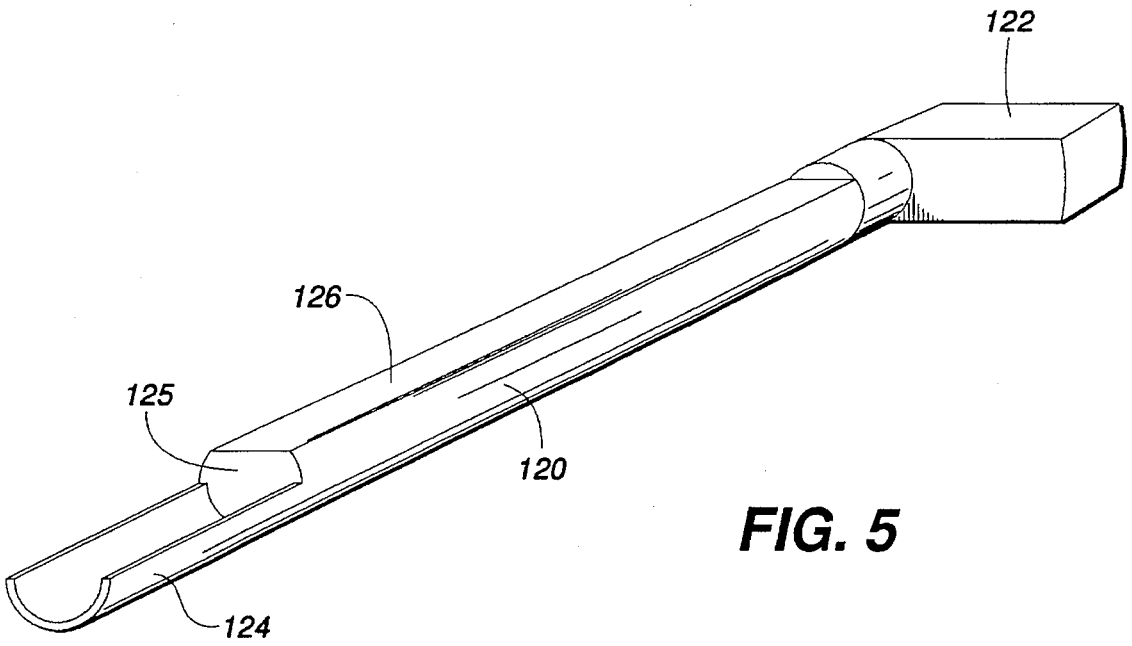
FIG. 5 is a perspective view of the extraction device of the dispenser of FIG. 1, illustrating the arcuate cutting edge and handle.

In the preferred embodiment, the extraction device 110 is a plunger comprising an elongated shaft 120 having a handle 122 mounted to one end and a cutting blade 124 mounted to the opposite end, as shown in FIG. 5. The cutting blade 124 is arcuate in cross-section and approximately three inches in length. A longitudinally disposed flat cutaway surface 126 expands the length of shaft 120. The extraction device 110 is slidably mounted through an aperture (not shown) in housing 12 and includes a retraction spring 130 wrapped about shaft 120 for biasing the extraction device 110 in an extended position.

Accordingly, when disc carriage 26 is moved to the forward position where it is held in place by detent means 68 and supported by block 74, extraction device 110 can be actuated by pressing down on handle 122 so that drive shaft 120, and more particularly cutting edge 124, pierces the film layers 38, 39 and then passing through the aperture(s) 36 containing the dose lot so as to release the medication therein. As cutting edge 124 pierces top film layer 39 and bottom film layer 38, a substantially flat end portion 125 of shaft 120 urges the medication out of aperture 36 so as to ensure the medication is extracted. The cutting blade 124 does not completely cut film layers 38, 39 around the apertures 36 because flat cutaway surface 126 allows at least a small portion of film layers 38, 39 to remain attached to the disc 34. Consequently, the medication received in dose tray 114 is not littered with fragments of film layers 38, 39. Upon the extracting the medication contained within the dose module 32, the operator releases handle 122 so that shaft 120 is returned to an extended position by retraction spring 130. Subsequently, slide lever 64 is released from detent means 68 allowing disc carriage 26 to be returned to its rear position by springs 76.

During the operation of PMD 10, doors 18, 20 remain locked to prevent access to the medication compartments 22. For purposes of illustrating the present invention, locking devices 134 comprise a hook and latch mechanism which may be opened by a key that is inserted into a latch 136 mounted to the side of housing 112. In the preferred embodiment, there is a separate locking device 134 for section 14 and section 16 because prescriptions for the non-solid medications do not have to be filled as often as for solid medications. In order to ensure that doors 18, 20 are closed after each use of PMD 10, a security buzzer 138 is provided on the top of housing 12 for indicating that a door is not properly closed. Security buzzer 138 operates off contact closure switches (not shown) associated with each door 18, 20. Though not shown in the figures, it is within the scope and breath of the present invention to include a rear door in back wall 78. The rear door would operate in substantially the same manner as door 18, 20, including the locking features. Such a door would be a useful means for providing access to the rear area of housing 12, especially to remove medication for long term facility patients who are going on leave, to access medication reserved for unscheduled doses or double doses, or to remove discontinued prescription medication.

Figure 7:
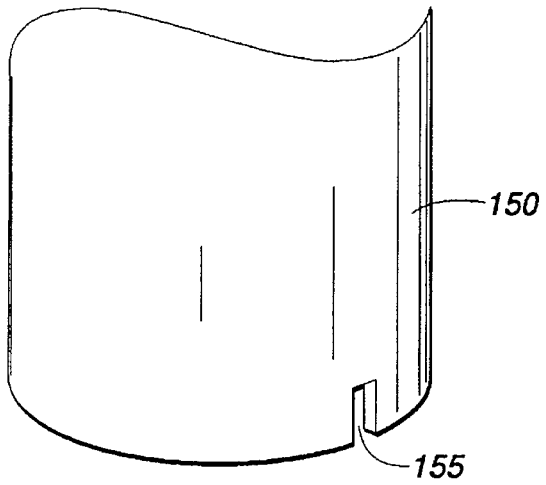
FIG. 7 is an exploded perspective view of the coupling between the programmable cam shaft and timer mechanism of the index means of FIG. 6.

In the preferred embodiment, the index means 84 comprises a programmable cam shaft 150 rotatably mounted to a timer mechanism 152, as generally illustrated in FIGS. 4 and 6. The timer mechanism 152 of the preferred embodiment is a twenty-four hour multiple position timer having a rotating face 153 (FIG. 7) which incrementally rotates 360° in a twenty-four hour cycle. The timer mechanism 152 is driven by 110 volt alternating current so that it may be plugged into a wall outlet, though a battery back-up system is recommended. A suitable timer for timer mechanism 152 can take many different forms which are commercially available, such as the Toastmaster Timer from Toastmaster, Inc., Ingram Time Product, Lawrenceburg, N.C., U.S.A. In the preferred embodiment, the Toastmaster timer is provided with an upwardly projecting male connector 154 rigidly mounted to the rotating face 153 thereof.

The programmable cam shaft 150 is preferably a plastic tubular member, circular or elliptical in cross-section. The programmable cam shaft 152 is vertically oriented and mounted at its lower end to a projecting male connector on the rotatable face 153 of timer mechanism 152. The lower portion of programmable cam shaft 150 is equipped with a female connector 155 (FIG. 7) for coupling to the male connector 154 of timer mechanism 152 so that cam shaft 150 is rotatable under the action of the rotating face 153 of timer mechanism 152. The Cam shaft 150 extends upward from timer mechanism 152 to the top of housing 12 where it is rotatably received by an adapter 157 mounted to the bottom of a door 158 in the top of housing 12. Thus, cam shaft 150 is held in place by the rotating face of timer mechanism 152 and adapter 157 so as to be freely rotatable under the action of the rotating face of the timer mechanism 152. The door 158 is hinged to the top of housing 12 in order to provide for the removal of programmable cam shaft 150 so that it can be programmed and re-inserted. Alternatively, cam shaft 150 can be removed through the rear door if one is provided. A locking means 160 is provided for securing door 158 to prevent cam shaft 150 from being tampered with once programmed and inserted into housing 12.

Cam shaft 150 comprises a plurality of programmable cams, generally denoted by reference numeral 162, that are and slidably fitted over cam shaft 150. Associated with each disc carriage 26 is at least one programmable cam 162. The programmable cams 162 comprise plastic rings approximately one quarter inch thick. Programmable cams 162 are slidably received on cam shaft 150 so as to be rotatable about cam shaft 150. Programmable cams 162 are retained in place by ball and socket detent means (not shown) similar to that widely used with such devices as the rotating bezel on a scuba-diver's watch. The ball and socket detent means comprises equally spaced spring loaded detent balls mounted about the inside of cams 162 so as to be in operational contact with corresponding sockets similarly spaced about the circumference of cam shaft 150. If desired, a single ball can be utilized with multiple sockets. Accordingly, cams 162 may be rotated in relation to shaft 164 in an incremental manner as detent balls pass from socket to socket about the periphery of cam shaft 150.

The cams 162 utilized in the present invention are a module index cam 170, a dose indication cam 172 and a reference time cam 174. One of each of the cams 170, 172 and 174 is associated with each disc carriage 26, as shown in FIG. 6. A raised cam surface 166 is provided on the outside diameter of module index cam 170 and dose indication cam 172.

The cam shaft 150 is positioned at the rear of housing 12 so that it extends up through notches 82 at the rear of each of the disc carriages 26 so that cam surface 166 comes into frictional contact with the rotatably mounted dose modules 32 positioned on respective disc carriages 26. As timer mechanism 152 rotates throughout a twenty-four hour period, raised cam surface 166 contacts the bottom disc of dose module 32 so as to index or rotate dose module 32 one position so that a subsequent dose lot is in position above aperture 52 for extraction (FIG. 4). The amount of rotation of dose module 32 is determined by the length of raised cam surface 166. By varying the length of surface 166, the amount of rotation can be adjusted to accommodate disc 34 having different aperture spacing.

The cam surface 166 on module index cam 170 is configured to index or rotate the associated dose module 32 of disc carriage 26 a prescribed amount so that the next dose lot to be extracted from module 32 is positioned above aperture 52 of disc carriage 26.

The cam surface 166 of dose indication cam 172 is configured to actuate locking and dose indication mechanism 176. The locking and dose indication mechanism 176 is provided on each disc carriage 26 as shown in FIGS. 2, 4 and 6. The mechanism 176 locks each disc carriage 26 in its rear position so that the medication of the dose module is not able to be extracted until cam 172 actuates mechanism 176 so as to unlock the disc carriage. When unlocked, the disc carriage can be actuated into its forward position. In addition to unlocking the disc carriage, mechanism 176 actuates a dose indication light 92 and timer buzzer 182 when a particular dose of medication is to be taken.

The mechanism 172 includes sliding rod 177 horizontally positioned within a cavity 178 in disc carriage 26 so as to be radially actionable with respect to cam shaft 150. The sliding rod is biased toward cam shaft 150 by a spring (not shown) so that one end of rod 177 is adjacent cam shaft 150, horizontally aligned with indication cam 172. A push button switch 180 having a button 181 is positioned adjacent the opposite end of rod 177 so as to be toggled when rod 177 is radially actuated by cam surface 166 of cam 172. Accordingly, as cam shaft 150 is rotated, the raised cam surface 166 of cam 172 radially displaces rod 177 within cavity 178, urging rod 177 against the button 181 of switch 180. As the button 181 is depressed, switch 180 actuates both the light 92 and the buzzer 182. Further, by depressing button 181, the laterally protruding lip 179 of disc carriage 26 clears button 181 permitting disc carriage 26 to be slidably actuated into a forward position via slide lever 64. At the end of the dose administration period, that is, when cam surface 166 passes rod 177, the rod 177 returns to its biased position releasing button 181 so that it extends past lip 179 once again, locking disc carriage 26 in place until the next dose administration period.

Associated with timer buzzer 182 is a warning light 184 which flashes when timer buzzer 182 has been actuated. Further, a two position buzzer setting switch 186 is provided on the top of housing 12. The buzzer setting switch 186 is used to set whether the buzzer 182 is to go off at the beginning or end of a dose administration period.

In order to program cams 170 and 172 to actuate dose module 32 and mechanism 176, respectively, at the appropriate time of day, a reference time cam 174 is provided. Reference time cam 174 is rigidly secured to shaft 164 so that all reference time cams 174 remain aligned with one another through the operation of PMD 10. The time indicated on cams 174 is coordinated with the rotating face 153 of time mechanism 152 so that when time mechanism 152 is turned on, the times reflected on cams 174 correspond to the actual time of day.

If the dose lot requires more than two medications, it is within the scope and spirit of the present invention to have housing 12 adaptable to accommodate the removal of individual disc carriages 26 so that dose modules of more than two discs can be received in a medication compartment 22, as generally illustrated in phantom lines and denoted as reference numeral 196 in FIG. 6. In such case, it should be noted that the cams associated with the removed disc carriage 26 can either be removed or programmed to coincide with the index cam 170 of the disc carriage which receives the large dose module so that the cams work together to index the dose module.

OPERATION

In the operation of PMD 10, the PMD is first loading with the prescribed medication. The non-solid medication is placed individual trays 124 of section 114. The solid medication is packaged in medication discs 34 which are then organized into dose modules that comprise the medication the person is to take at a particular time of the day, i.e., a dose lot. For example, a dose lot may include two pills which are to be taken at 8:00 a.m. each day so the dose module for that dose lot would include two discs 34, one for each pill. If a dose module 32 includes more than one disc, the discs are stacked and aligned by inserting a shaft 48 through the alignment holes 46 of each respective disc. Each dose module 32 is then placed in a separate medication compartment 22 onto a disc carriage 26 so that the bore in the bottom of each shaft 48 receives the rotational pin 50 of the corresponding disc carriage 26. Further, each dose module 32 is aligned on disc carriage 26 by guide means (not shown) so that a dose lot from dose module 32 is positioned over aperture 52 in position for extraction.

Once the medication has been placed in housing 12, doors 18, 20 are closed and locked. Next, cam shaft 150 is removed through door 158 (or a rear door if provided) so that cams 170, 172 can be programmed in accordance with the administration schedule of the medication loaded onto the disc carriages. This is accomplished by rotating cams 170 and 172 so that their cam surfaces 166 are positioned in alignment with the appropriate administration time indicated on reference time cam 174. The programmed cam shaft 150 is then reinserted into housing 12 and coupled to timer mechanism 152 via male connector 154 and female connector 155. Lastly, door 158 is closed and locked.

PMD 10 is now ready to be turned on once the timer mechanism 152 is set to the correct time of day.

In order to allow a window of time for loading PMD 10 at the end of a prescription, PMD 10 can be equipped with a modified tray or medication disc capable of holding dose lot cups. Thus, when the new dose modules and non-solid medications are being loaded into the PMD, the medication being removed is manually extracted and placed into the dose lot cups. An administration cam associated with the modified disc or tray is programmed to actuate light 92 and buzzer 183 when a dose of medication from that disc or tray 13 is to be taken. Preferably, the modified disc or tray will accommodate up to one full day of medication so that there is up to a one day window at the end of a prescription to refill PMD 10.

Once turned on, the cam shaft 150 continuously rotates in an incremental fashion, as controlled by timer mechanism 152. Cam shaft 164 makes one revolution every twenty-four hours. Thus, cam 170 associated with each disc carriage 26 is preferably programmed to index all the dose modules 32 at midnight as shown by cams 170 in FIG. 6. Thus, at midnight, the subsequent dose lot of each dose module 32 is ready for dispensing the following day.

Additionally, as cam shaft 150 rotates, cams 172 actuate the respective locking and dose indication mechanism 176 at the programmed time for administration of the medication of the associated dose module 32. When the cam surface 166 of a cam 172 comes into contact with sliding rod 177, the rod is driven radially away from the cam shaft 150 so as to actuate switch 180 by depressing button 187. By actuating switch 180, indication light 92 and timer buzzer 183 are actuated, providing both visual and audible indication that it is time to take medication. As previously mentioned, the timer buzzer 183 can be set with setting switch 186 to go off at either the beginning or end of the dose administration period. Once the dose administration period has passed and switch 180 is no longer actuated, indication light 92 goes off as does timer buzzer 183. It is well within the scope of the present invention to incorporate a "wait mode" on timer buzzer 183, analogous to a "snooze" button on an alarm clock, so that the buzzer can be interrupted for a predetermined period of time.

In order to dispense the medication during the dose administration period, the operator slides lever 64 forward, securing it in a forward position with detent means 68. This moves disc carriage 26 from a rear position to a forward position, as shown in FIG. 1. By actuating disc carriage 26 to a forward position, indication light 92 and timer buzzer 183 are turned off.

The operator then actuates extraction device 110 by pressing down on handle 122 of shaft 120. This drives shaft 120 and cutting edge 124 through the apertures 36 containing the medication for the dose lot. The support block 74 provides support to the disc carriage at the arcuate edge 72 as the shaft 120 and cutting edge 124 are driven through apertures 36 of dose module 32. As films 38, 39 are cut, the medication contained in apertures 36 is released allowing it to fall into compartment 112 where it is received by tray 114. The deflector walls 86 of respective disc carriages 26 prevent the extracted medication from being caught on lower disc carriages 26. The operator then releases handle 122 so as to allow extraction means 110 to return to an extended position under the force of retraction spring 130.

Once the medication has been extracted from dose module 32, disc carriage 26 is then returned to a rear position under the force of spring 76 by releasing slide lever 64 from detent means 68. The medication received in tray 114 is then administered by removing tray 114 from housing 12 through slot 116 in door 20. The tray 114 is then replaced until the next dose lot is extracted for administration in substantially the same manner as described above.

If the medication is not extracted from the dose module 32 during the dose administration period, the medication is retained in order to provide historical information as to which doses were missed and to provide means for reclaiming the medication so that it will not be wasted.

ALTERNATIVE EMBODIMENT

Figure 8:
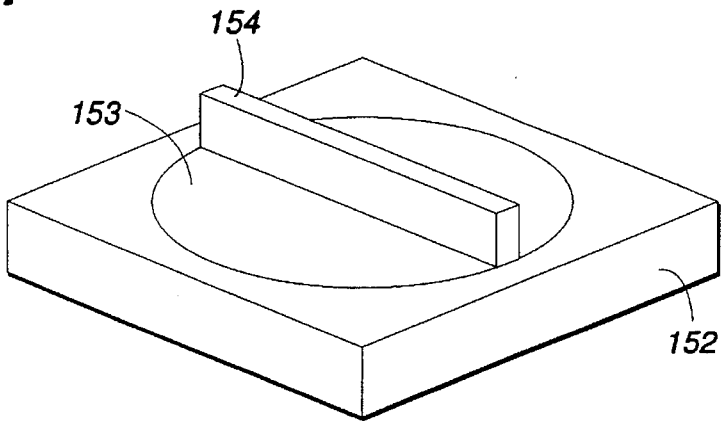
FIG. 8 is a high level block diagram of a microprocessor control system as an alternative embodiment of the index means of the dispenser of FIG. 1.
Figure 8:
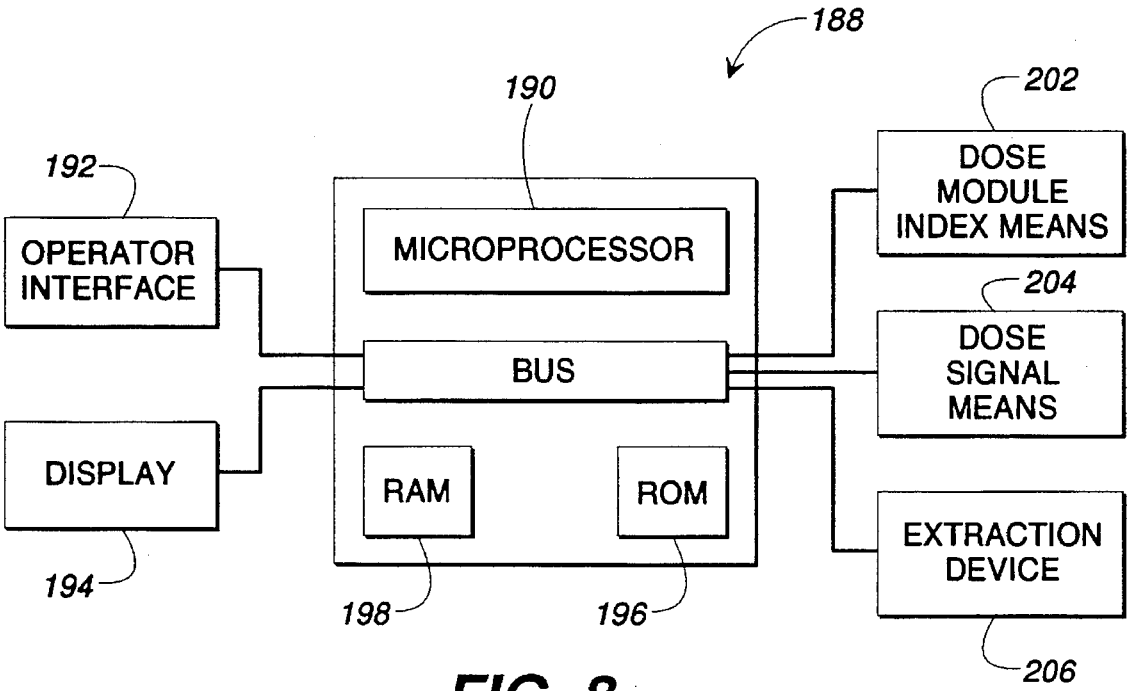

In an alternative embodiment, PMD 10 can be modified by incorporating a microprocessor controlled system, such as system 188 illustrated in FIG. 8. System 188 includes a microprocessor 190 in communication with an operator interface 192 and a display 194. The operator interface can comprise a keyboard or like device by which the operator can enter pertinent patient and dose schedule information required for the operation of PMD 10. The information entered is stored in random access memory, such as RAM 196. In addition, the programming required to operate microprocessor 190 and PMD 10 is stored in read only memory (ROM) 198 and RAM 196, collectively referred to as the system memory. In communication with and controlled by the microprocessor 190 are a dose module index 202, dose signal means 204, and extraction means 206.

The dose module indexer 202 comprises a stepper motor to replace timer mechanism 152. Thus, at the appropriate time, microprocessor 190 actuates indexer 202 to advance cam shaft 150 in substantially the same manner as did timer mechanism 152. The dose signal means comprises suitable electrical circuitry for actuating during medication dispensing periods both audible and visual indicators, such as indication light 92 and timer buzzer 182. The extraction means 206 comprises solenoids to replace slide levers 64 so that, when actuated, respective solenoids or retract urge individual disc carriages 26 forward from a rear position to a forward position. Further, extraction means 206 includes a second reversible stepper motor having a pinion gear that mates with a rack gear on the flat cutaway surface 126 of shaft 120. By actuating the second stepper motor, shaft 120 can be raised or lowered in substantially the same manner as previously done manually.

In operation, the operator enters the pertinent patient and medication schedule information into microprocessor 190 via interface 192 and display 194. The information entered is stored in the system memory (i.e., RAM 196). At the appropriate time, microprocessor 190 begins actuating dose signal means 204 to indicate that a dose lot of prescribed medication should be dispensed from PMD 10 and administered to a patient. Accordingly, the operator actuates the extraction of the dose lot via an eject switch button mounted to housing 12. By depressing the eject bottom, the disc carriage solenoids urge the particular disc carriage 26 to the forward position and the ejector shaft 120 is lowered via actuation of the second stepper motor. The shaft 120 passes through the apertures containing the dose lot, releasing the medication contained therein. The released medication falls into tray 114. The medication is then removed from tray 114 and administered to the patient. Subsequently, before the next dose lot is to be dispensed from that dose module, the dose module indexer means is actuated by microprocessor 190 to index the dose modules which causes the stepper motor to rotate cam shaft 150 accordingly.

In a substantially similar fashion, the microprocessor system 188 operates to dispense all medication stored in dose lots in dose modules located into PMD 10.

It will be obvious to those skilled in the art that many modifications and variations may be made to the embodiments described above without departing from the novel teachings of the present invention. All such modifications and variations are intended to be incorporated herein all within the scope of the present invention, as set forth in the following claims.

Wherefore, the following is claimed:

1. An apparatus for dispensing a combination of medications in dose lots at timed intervals, comprising:

a housing;

a plurality of dose modules rotatably mounted in said housing, each said dose module including at least one circular disc, each said disc having a plurality of apertures therethrough, wherein each said aperture is sealed on either side with film so as to form a compartment in which a single dose of a medication is contained;

extractor means mounted to said housing for selectively piercing said film covering said apertures so as to release the medication contained in respective said apertures;

signaling means mounted to the exterior of said housing for periodically indicating a time medication is to be taken; and dose module index means for indexing each said dose module at a predetermined interval and for actuating said signaling means.

2. The apparatus of claim 1 wherein a label is attached to each said disc, said label including at least one bar code containing information such as patient number, nursing home number, medication number, manufacturer number and manufacturers bar code.

3. The apparatus of claim 2 when said label is substantially centered on said disc.

4. The apparatus of claim 1 wherein each said dose module comprises a plurality of said disc vertically stacked.

5. The apparatus of claim 4 wherein said apertures of respective said disc of a dose module are vertically aligned with corresponding said apertures of adjacent said disc so that the medication contained in corresponding said apertures form a single dose of medication.

6. The apparatus of claim 1 wherein said housing includes a plurality of parallel sliding disc carriages mounted horizontally in said housing, each said disc carriage configured to receive a single said dose module in a manner such that said dose module is rotatable thereon, whereby said sliding disc carriage must be actuated to enable said extractor means to release the medication contained in said dose module thereon.

7. The apparatus of claim 6 wherein each said sliding disc carriage is located at a rear position within said housing until a time the medication of said dose module thereon is to be taken, and comprising a timer mechanism for actuating a cam shaft that includes a cam for rotatable indexing said dose modules, a cam for actuating said signaling means and a cam for unlocking said sliding disc carriage.

8. The apparatus of claim 1 wherein said signaling means include an audible and a visual indicator.

9. The apparatus of claim 1 wherein said housing includes at least one tray for receiving non-solid oral dose medication.

10. The apparatus of claim 1 wherein said extractor means comprise a shaft having a handle at a first end and an arcuate cutting blade at a second end.

11. The apparatus of claim 10 wherein said shaft of said extractor means is substantially cylindrical with a flat cutaway surface extending the length of said shaft so that when said plunger means is urged through an aperture in said disc, said cutting blade initially pierces said film and cuts said film partially around said aperture and then said shaft plunges the medication contained in said aperture further severing said film around said aperture with a portion of said film adjacent to said flat surface of said shaft remaining in attached to said disc whereby the medication is released from said aperture and said film cut and severed by said extractor means remains attached to said disc by said portion of said film.

12. The apparatus of claim 1 and further including a receptacle for receiving the medication released from said dose module.

13. The apparatus of claim 1 wherein said dose module index means includes a programmable timer mechanism.

14. The apparatus of claim 1 wherein said dose module index means comprise a cam shaft having programmable cams for selectively rotating each said dose modules at programmable intervals, said cam shaft coupled to a timer mechanism for actuating said cam shaft.

15. The apparatus of claim 14 wherein said cam shaft comprises a first cam associated with each said dose module for indexing said dose module between doses and a second cam associated with each said dose module for actuating said signaling means.

16. The apparatus of claim 1 wherein said disc constructed with styrofoam.

17. A programmable medication dispensing device for dispensing medications individually sealed in one or more containers, comprising:

a housing for receiving a container;

extraction means mounted to said housing for extracting a particular dose of medication from said container at programmed intervals by breaking a seal enclosing said dose of medication in said container;

programmable index means for positioning said container within said housing for extraction of medication from said container by said extraction means; and signaling means associated with said device for indicating when a particular dose of medication is to be taken.

18. The dispensing device of claim 17 wherein said container comprises a disc having a plurality of apertures there through, said disc being sealed on either side with film so as to form a plurality of compartments wherein each said compartment is configured to receive a single dose of medication.

19. The dispensing device of claim 17 when a label is attached to each side of said container, said label including at least one bar code containing information pertinent to the medication within said container.

20. The dispensing device of claim 17 wherein said signaling means include an audible and visual indicator.

* * * * *